US008689938B2

(12) United States Patent
Kenton et al.

(10) Patent No.: US 8,689,938 B2
(45) Date of Patent: Apr. 8, 2014

(54) COLLAPSIBLE SAFETY RAIL SYSTEM

(75) Inventors: Gregory S. Kenton, Mound, MN (US); Anthony J. Mertes, Chanhassen, MN (US)

(73) Assignee: Gregory S. Kenton, Mound, MN (US)

( * ) Notice: Subject to any disclaimer, the term of this patent is extended or adjusted under 35 U.S.C. 154(b) by 1648 days.

(21) Appl. No.: 11/149,569

(22) Filed: Jun. 10, 2005

(65) Prior Publication Data

US 2006/0278472 A1 Dec. 14, 2006

(51) Int. Cl.
*E04G 5/14* (2006.01)

(52) U.S. Cl.
CPC . *E04G 5/14* (2013.01); *Y10S 256/02* (2013.01)
USPC ..... 182/113; 182/178.5; 182/178.6; 256/DIG. 2

(58) Field of Classification Search
USPC ..... 182/113, 178.5, 178.6; 256/67, DIG. 2; 248/167, 511, 512, 519; 40/606.01, 40/607.01, 607.02, 607.04, 610; 403/100
See application file for complete search history.

(56) References Cited

U.S. PATENT DOCUMENTS

| | | | | | |
|---|---|---|---|---|---|
| 79,141 | A * | 6/1868 | McFarlin | 49/10 |
| 112,250 | A * | 2/1871 | Hunter | 49/10 |
| 446,852 | A * | 2/1891 | Davis | 49/10 |
| 1,293,612 | A * | 2/1919 | Magley | 52/116 |
| 1,335,302 | A * | 3/1920 | Stout | 403/2 |
| 1,575,040 | A * | 3/1926 | Crum | 116/173 |
| 3,776,521 | A * | 12/1973 | Weinert | 256/24 |
| 3,788,608 | A * | 1/1974 | Raymond et al. | 256/59 |
| 3,792,680 | A * | 2/1974 | Allen | 116/173 |
| 4,032,248 | A * | 6/1977 | Parduhn et al. | 404/10 |
| 4,084,277 | A * | 4/1978 | Conrad et al. | 5/430 |
| 4,183,695 | A * | 1/1980 | Wilcox | 404/6 |
| 4,611,945 | A * | 9/1986 | Diego | 403/61 |
| 4,696,470 | A * | 9/1987 | Fenner | 482/142 |
| 4,860,683 | A * | 8/1989 | Herrera Sanguinetti | 114/364 |
| 5,188,342 | A * | 2/1993 | Ouellette et al. | 256/65.08 |
| 5,539,957 | A * | 7/1996 | Schmidt | 16/331 |
| 5,647,451 | A * | 7/1997 | Reichel | 182/45 |
| 5,746,533 | A * | 5/1998 | Schmidt | 403/102 |
| 5,781,945 | A * | 7/1998 | Scherer et al. | 5/426 |
| 6,158,705 | A * | 12/2000 | Cudmore et al. | 248/354.1 |
| 6,220,776 | B1 * | 4/2001 | Reeves | 403/102 |
| 6,315,251 | B1 * | 11/2001 | Stoudt et al. | 248/156 |
| 6,371,873 | B1 * | 4/2002 | Wang | 473/478 |
| 6,478,111 | B2 * | 11/2002 | Olson et al. | 182/3 |
| 6,554,257 | B1 * | 4/2003 | Kenton | 256/24 |
| 6,626,410 | B2 * | 9/2003 | Marcotte et al. | 248/548 |
| 6,668,474 | B2 * | 12/2003 | Winterton et al. | 40/610 |
| 6,845,970 | B1 * | 1/2005 | Kenton | 256/73 |
| 7,243,450 | B2 * | 7/2007 | Dicke et al. | 40/607.1 |

* cited by examiner

*Primary Examiner* — Alvin Chin Shue
*Assistant Examiner* — Colleen M Chavchavadze
(74) *Attorney, Agent, or Firm* — Westman, Champlin & Koehler, P.A.; Z. Peter Sawicki

(57) ABSTRACT

A collapsible safety rail system for providing a portable or permanent protective barrier to provide for fall prevention from elevated or other work areas. Lockable pivot assemblies are located between heavy bases and the end posts of collapsible safety rail assemblies. Removable detent pins are utilized to lock the pivot assemblies to maintain the erected position of the collapsible safety rail assemblies in protective vertical orientation or are removed to allow maneuvering of the collapsible safety rail assemblies to a minimum viewable profile position when not required for personnel protection.

20 Claims, 12 Drawing Sheets

COLLAPSIBLE SAFETY RAIL SYSTEM

CROSS REFERENCES TO RELATED APPLICATIONS

This patent application is related to application Ser. No. 10/916,688 entitled "Gate Section and Base for a Safety Rail System" filed on Aug. 11, 2004, now U.S. Pat. No. 6,902,153, which is a divisional of application Ser. No. 10/319,992 entitled "Gate Section and Base for Safety Rail System" filed Dec. 16, 2002, now U.S. Pat. No. 6,845,970, which is a continuation-in-part of application Ser. No. 09/595,794 entitled "Safety Rail System" filed Jun. 16, 2000, now U.S. Pat. No. 6,554,257.

BACKGROUND OF THE INVENTION

1. Field of the Invention

This invention pertains to a safety rail system, and more particularly, pertains to a collapsible safety rail system for providing a portable or permanent protective barrier to provide for fall prevention from elevated or other work areas.

2. Description of the Prior Art

Prior art safety rail systems or other fall prevention systems have been provided to prevent workers or other personnel from falling off an elevated work area, such as a rooftop, or to prevent personnel from falling into open work pits. Some fall prevention systems are only used occasionally and the temporary erection of a fall prevention system, such as at the edge of a building roof, can prove to be costly and time consuming. Often, aesthetics require that safety rail/guard rail systems be out of sight or that the systems be completely removed as to not detract from the beauty or aesthetics of a building or other publicly viewed area when not in use. One method of keeping a fall prevention system out of sight is by providing a low profile mounted horizontal lifeline in close proximity to a roof surface. Both ends of a horizontal lifeline are firmly anchored into structure underlying the waterproof region of a roof. A workman then dons a harness having a safety line and attaches the distant end of the safety line to the span of the lifeline to traverse the length of the horizontal lifeline. While being out of sight, the horizontal lifeline offers fall protection; however, a secure and waterproof installation of the horizontal lifeline can be difficult and expensive. Additionally, a horizontal lifeline system is an active fall prevention system requiring that an individual must actively don a harness having a safety line which then must be connected to the span of the horizontal lifeline. If an individual neglects to don the harness and connect the safety line, then the attributes of such an active system are not realized. A passive fall prevention system such as provided by the present invention does not require, after erection of the rails, any further action or connective maneuver by any personnel member. Protection is provided for all personnel, not just those who are connected such as to a lifeline.

SUMMARY OF THE INVENTION

The general purpose of the present invention is to provide a collapsible safety rail system which is portable and which is intended to be used to provide for fall protection from elevated or other work areas where human safety is an issue. The collapsible safety rail system is a portable system which can be broken down to a plurality of individual collapsible safety rail assemblies and a plurality of heavy and substantial cast iron bases which support the collapsible safety rail assemblies. The collapsible safety rail assemblies include a plurality of rails and end posts where a pivot assembly comprises the lower portion of each end post. Each pivot assembly includes a slotted tubular base which is stationary and a multi-radius mounting fixture pivotably secured to the upper region of the slotted tubular base. A pivot pin secures between an upper region of the slotted tubular base and through a pivot pin hole in a reduced radius shaft portion of the mounting fixture. A detent pin secures between an upper region of the slotted tubular base and through a detent pin hole in the reduced radius shaft portion of the mounting fixture. The lower region of the slotted tubular base aligns and secures within a post receiver in the cast iron base and can be rotated therein. The lower portion of an end post of the collapsible safety rail assembly aligns over and suitably secures about an end post mount at the upper portion of the mounting fixture. The collapsible safety rail assembly can be pivoted horizontally about the pivot pins subsequent to removal of the detent pins to a substantially horizontal and flat orientation, thereby reducing the viewable profile of the collapsible safety rail system and positioning the collapsible safety rail system completely out of view provided that the lower structure of the invention is located on an otherwise nonviewable area.

The bases of substantial weight are vital components of the collapsible safety rail system and enable the system to be as versatile as described herein. A base according to this invention has four post receivers so as to enable as many as four assemblies or devices including the collapsible safety rail assembly, as well as other patented devices by the inventor, such as, but not limited to, rail sections, latching posts, gate posts, or related devices, to be engagingly incorporated at any one time. Designed into each of the post receivers are strategically positioned slots, being horizontally aligned and being elongated. These slots align with at least two spaced holes in the lower region of the end posts of the collapsible safety rail assembly. This alignment enables the safety rail assemblies to be secured to the base at infinite positions along a 360° rotation with a locking pin. Thus, the collapsible safety rail system has the versatility to align to multiple protected work areas defined by the base placement. The base also incorporates four symmetrically positioned holes to enable a permanent mount to a surface via some form of anchor bolts, if desired. Further, the base includes cutouts and recesses which form recessed handles for manual grasping when it is necessary to move or carry the base. All edges of the recesses and the upper edges of the cutouts are rounded to eliminate sharp corners that could prove to be uncomfortable when the recessed handles are gripped. Yet another feature of the base is a stacking feature. Specifically, the base includes stacking recesses on its planar bottom surface in alignment with the post receivers. These stacking recesses receive the upper ends of the post receivers for stacking of bases when not in use. Drain holes coaxial with the post receivers and the stacking recesses extend through the base. Although collapsibility and portability of the collapsible safety rail system are major attributes of the invention, provisions are also made for continual use of the invention where the invention can be permanently secured and permanently utilized as a fixed but collapsible structure.

According to one or more embodiments of the present invention, there is provided a collapsible safety rail system which includes one or more collapsible safety rail assemblies having pivot assemblies and a plurality of bases. The pivot assemblies at the lower portions of the collapsible safety rail assemblies allow the collapsible safety rail assemblies to maintain an upright protective position or to allow the collapsible safety rail assemblies to be pivoted about the pivot assemblies to maintain a low and unobtrusive profile. The safety rail assemblies and plurality of substantial heavy bases provide for stability of the collapsible safety rail system to provide a robust structure which denies access to a hazard area or work area which is substantially unmovable when acted upon by any off balance, falling, or misdirected human form.

One significant aspect and feature of the present invention is a collapsible safety rail system incorporated to prevent access to hazardous areas or to prevent falls from roofs or other elevated structures or falls into hazardous areas.

Another significant aspect and feature of the present invention is a collapsible safety rail system which can surround or be located adjacent to a work area.

A further significant aspect and feature of the present invention is collapsible safety rail system having pivot assemblies which allow collapsible safety rail assemblies to be maneuvered to a low profile unobtrusive position.

A still further significant aspect and feature of the present invention is a collapsible safety rail system which, by the use of common bases, can also accommodate other rail sections, latching posts, gate posts, or related devices to be incorporated at any one time.

Still another significant aspect and feature of the present invention is the use of a pivot assembly between a heavy base and an end post of a collapsible safety rail assembly.

Yet another significant aspect and feature of the present invention is a pivot assembly having a slotted tubular base which pivotally accommodates a mounting fixture.

Yet another significant aspect and feature of the present invention is a mounting fixture having an end post mount and a reduced radius shaft.

Yet another significant aspect and feature of the present invention is a reduced radius shaft maximally sized to provide for suitable robustness.

A still further significant aspect and feature of the present invention is a collapsible safety rail system which can incorporate other rail sections, latching posts, gate posts, or related devices, some or all or none of which can include a pivot assembly.

Yet another significant aspect and feature of the present invention is a reduced radius shaft having a semispherical-shaped end to provide for suitable robustness.

Another significant aspect and feature of the present invention is a collapsible safety rail system which is portable.

Another significant aspect and feature of the present invention is a collapsible safety rail system which is portable, but which can be permanently mounted.

Yet another significant aspect and feature of the present invention is a collapsible safety rail system which uses heavy bases to provide for overall stability and robustness.

A still further significant aspect and feature of the present invention is a collapsible safety rail system which can be freestanding, but which can be permanently secured to a suitable mounting surface or structure utilizing mounting hardware extending through holes in the bases, if desired.

A still further significant aspect and feature of the present invention is a collapsible safety rail system having bases which are user-friendly for the purposes of manual handling, and which are stackable.

Having thus briefly described embodiments of the present invention and having mentioned some significant aspects and features of the present invention, it is the principal object of the present invention to provide a collapsible safety rail system.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
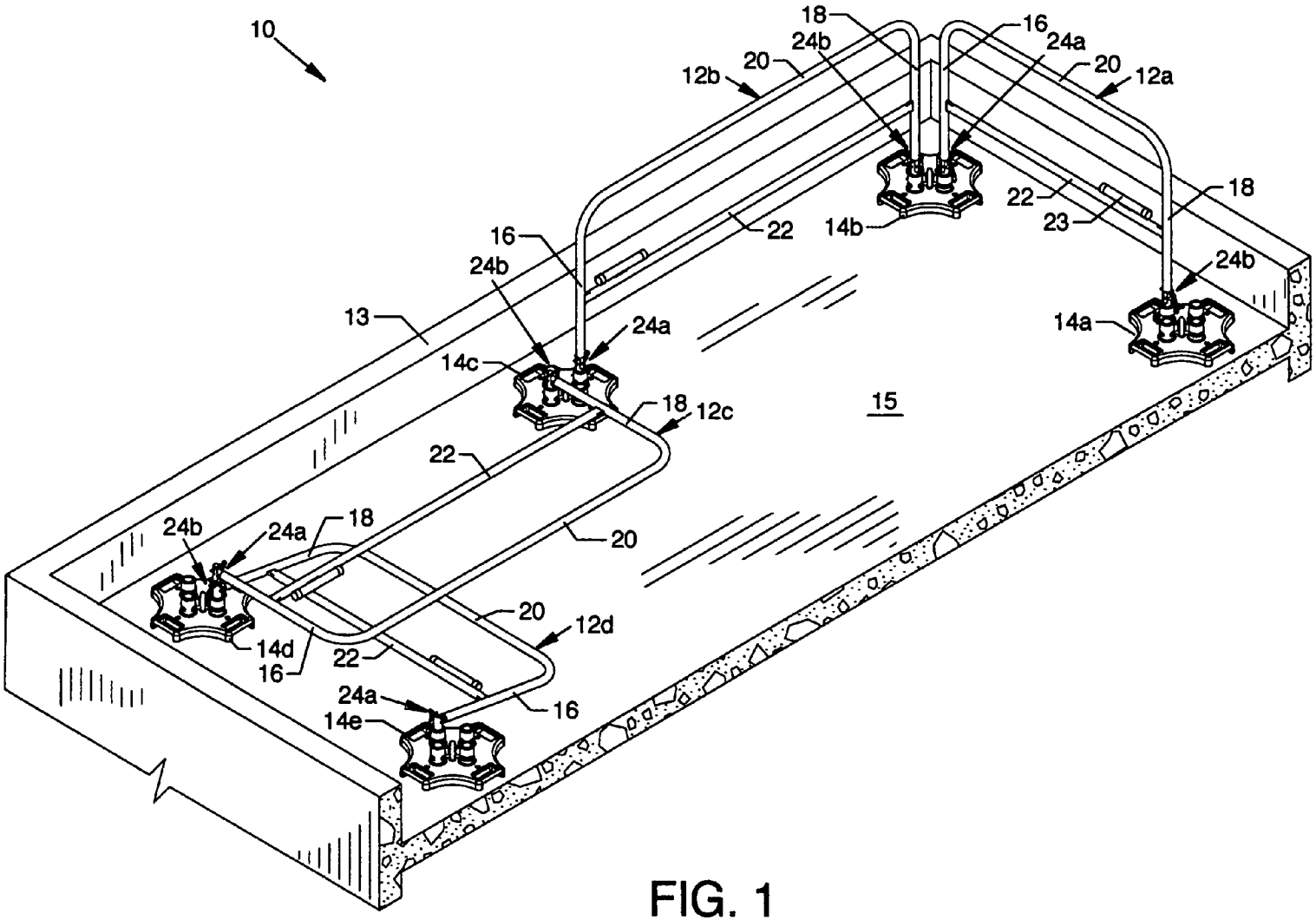
FIG. 1 is an isometric view showing the use and structure of the collapsible safety rail system, the present invention.

FIG. 1 is an isometric view of the collapsible safety rail system 10, the present invention, including a plurality of similarly constructed collapsible safety rail assemblies 12*a*-12*d* and a plurality of bases 14*a*-14*e* of substantial weight and size, each connectively associated with one or more collapsible safety rail assemblies 12*a*-12*d*. For purposes of illustration and example, the collapsible safety rail system 10 is shown in use for protection along the edge of a wall section 13 extending above the top surface of a roof 15 where the collapsible safety rail system 10 is shown partially in the protective mode and partially in the collapsed mode. Collapsible safety rail assemblies 12*a* and 12*b* are shown in the protective mode of operation being vertically erected with respect to the bases 14*a*-14*c* for prevention of access across the collapsible safety rail assemblies 12*a* and 12*b*. Collapsible safety rail assemblies 12*c* and 12*d* are shown in the collapsed mode of operation being substantially horizontally oriented with respect to the bases 14*c*-14*e* to provide for minimum viewable profile.

Figure 2:
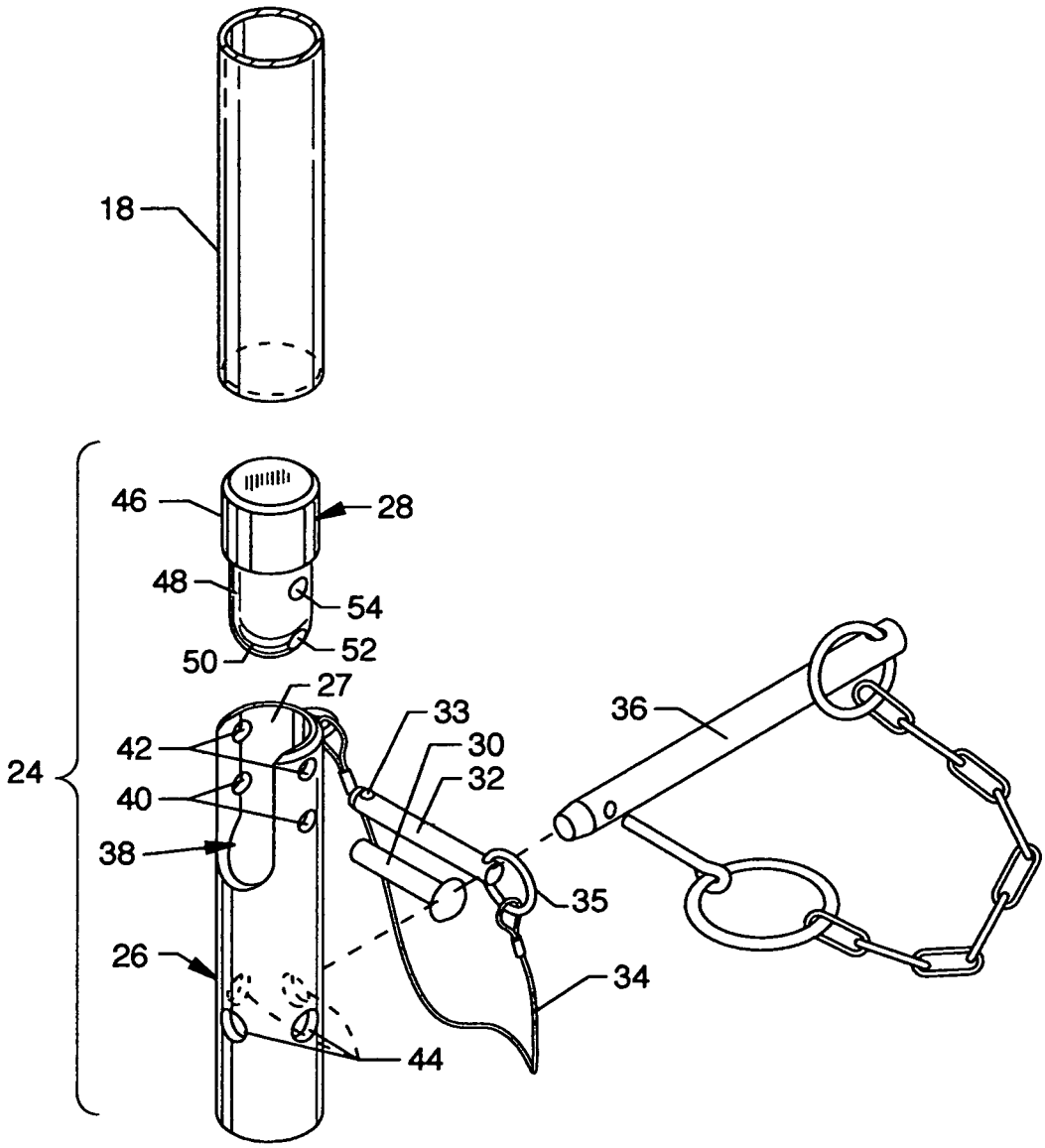
FIG. 2 is an exploded view of a pivot assembly in relationship to the lower portion of an end post.

The similarly constructed collapsible safety rail assemblies 12*a*-12*d* each includes opposed left and right end posts 16 and 18, a top horizontal rail 20 extending from the left end post 16 to the right end post 18, and a bottom horizontal rail 22 extending between the left end post 16 and the right end post 18. An accessible instruction storage tube 23 is located on each bottom horizontal rail 22. Individual pivot assemblies designated 24*a* and 24*b*, as described in detail as pivot assembly 24 in FIG. 2, are located at the ends of the left and right end posts 16 and 18 nearest the bottom horizontal rail 22, respectively, of each of the collapsible safety rail assemblies 12*a*-12*d*. A slotted tubular base 26 (FIG. 2), which is stationary, is located at the lower region of each of the pivot assemblies 24*a* and 24*b* and secures in the bases 14*a*-14*e*, as later described in detail.

FIG. 2 is an exploded view of the pivot assembly 24, multiply designated as pivot assemblies 24*a* and 24*b* in FIG. 1, in relationship to the lower portion of an end post 18. The pivot assembly 24 has major structural components including a stationary slotted tubular base 26 and a pivotable multi-radius mounting fixture 28, and also includes a pivot pin 30 and a detent pin 32 having a spring-loaded ball 33, the latter of which is secured to the slotted tubular base 26 by a lanyard 34 and ring 35. Also shown is another locking pin 36 including suitable hardware for securing of the pivot assembly 24 to one of the bases 14*a*-14*e*.

The slotted tubular base 26 includes a slot 38 in vertical orientation intersecting the wall of the slotted tubular base 26 at the upper region of the slotted tubular base 26. Opposed pivot pin holes 40 extend through the upper region of the slotted tubular base 26 for accommodation of the pivot pin 30, and opposed detent pin holes 42 aligned above the opposed pivot pin holes 40 extend through the upper region of the slotted tubular base 26 for accommodation of the detent pin 32. Four or another suitable number of locking pin holes 44 extend through the lower region of the slotted tubular base 26 for accommodation of the locking pin 36 when securing the pivot assembly 24 to a base 14*a*-14*e*. The multi-radius mounting fixture 28 includes a round end post mount 46 and a round reduced radius shaft 48 having a semispherical-shaped end 50 extending from the end post mount 46. The radius of the reduced radius shaft 48 is nearly as large as the radius of an inside surface 27 (see also FIG. 6) of the slotted tubular base 26. Such a relationship allows for robustness and maximizes the structural integrity of the mounting fixture 28 by providing sufficient structural mass about a pivot pin hole 52 extending through the lower portion of the reduced radius shaft 48. The pivot pin hole 52 accommodates the pivot pin 30, and a detent pin hole 54 aligned above the pivot pin hole 52 extends through the upper portion of the reduced radius shaft 48 for accommodation of the detent pin 32.

Figure 3:
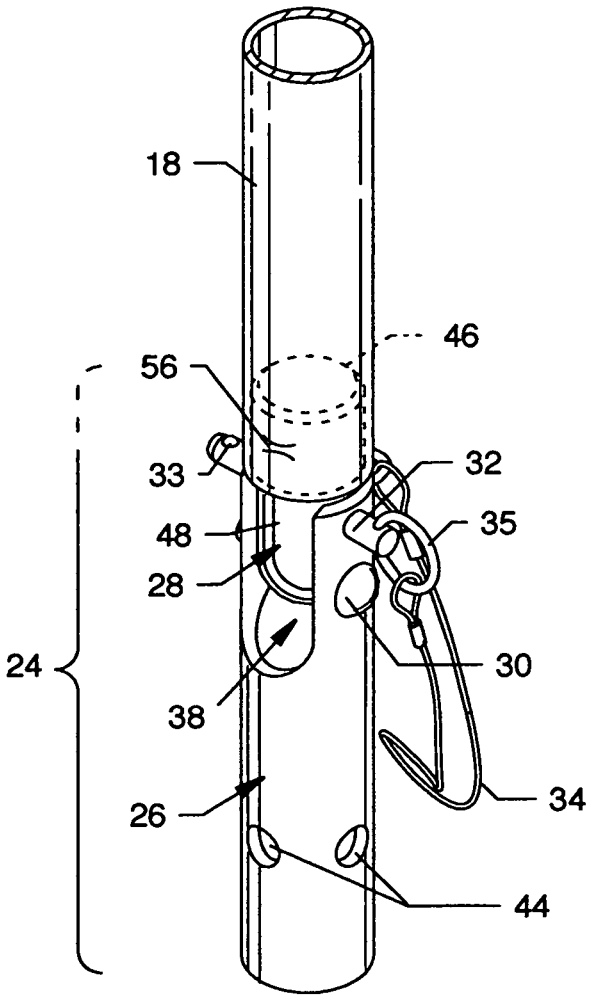
FIG. 3 is an assembled view of the pivot assembly connected to the lower portion of the end post.

FIG. 3 is an assembled view of the pivot assembly 24 attached to the lower portion of the end post 18. The end post mount 46 can be a close tolerance fit for suitable accommodation by the lower portion of the end post 18 and can be secured therein such as by swaging the end post 18 at one or more locations, such as is shown by one or more swages 56, or by other suitable methods, such as, but not limited to, welding, press fitting, the use of fasteners, and the like. The reduced radius shaft 48 is shown aligned vertically within the top region of the slotted tubular base 26 and secured therein by the pivot pin 30 which extends through the opposed pivot pin holes 40 in the slotted tubular base 26 and through the pivot pin hole 52 in the reduced radius shaft 48 and by the detent pin 32 which extends through the opposed detent pin holes 42 in the slotted tubular base 26 and through the detent pin hole 54 in the reduced radius shaft 48.

Figure 4:
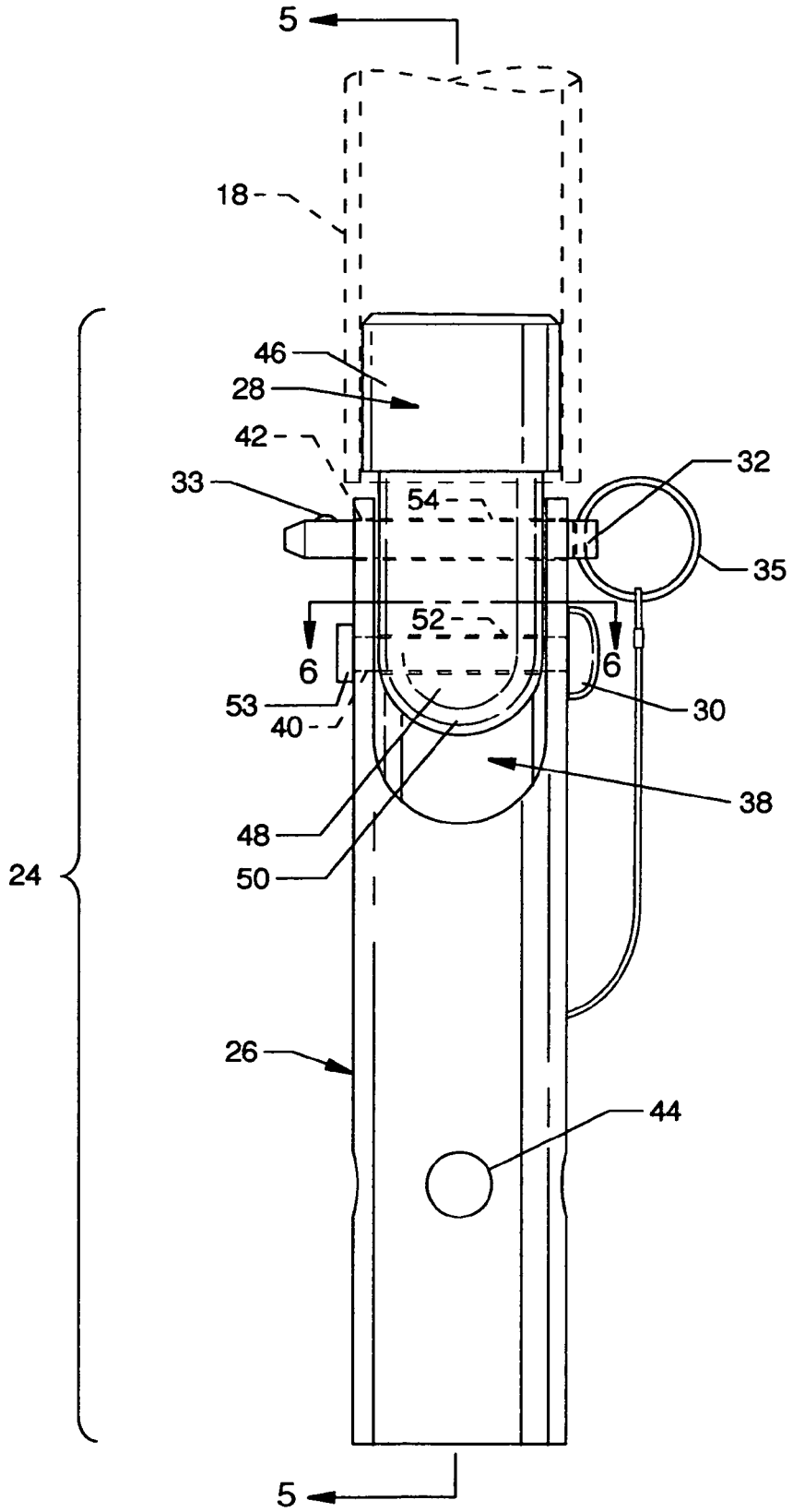
FIG. 4 is a front view of the assembled components of FIG. 3 with the lower portion of the end post depicted in phantom.

FIG. 4 is a front view of the assembled components of FIG. 3 with the lower portion of the end post 18 depicted in phantom. Shown in particular is the accommodation of the pivot pin 30 and of the detent pin 32, as described with reference to FIG. 2. One end of the pivot pin 30 is peened over at 53 to permanently maintain the position of the pivot pin 30. The spring-loaded ball 33 maintains the position of the detent pin 32 to ensure the upright positioning of the end post 18 when the collapsible safety rail assemblies 12*a*-12*d* are in the upright position.

Figure 5:
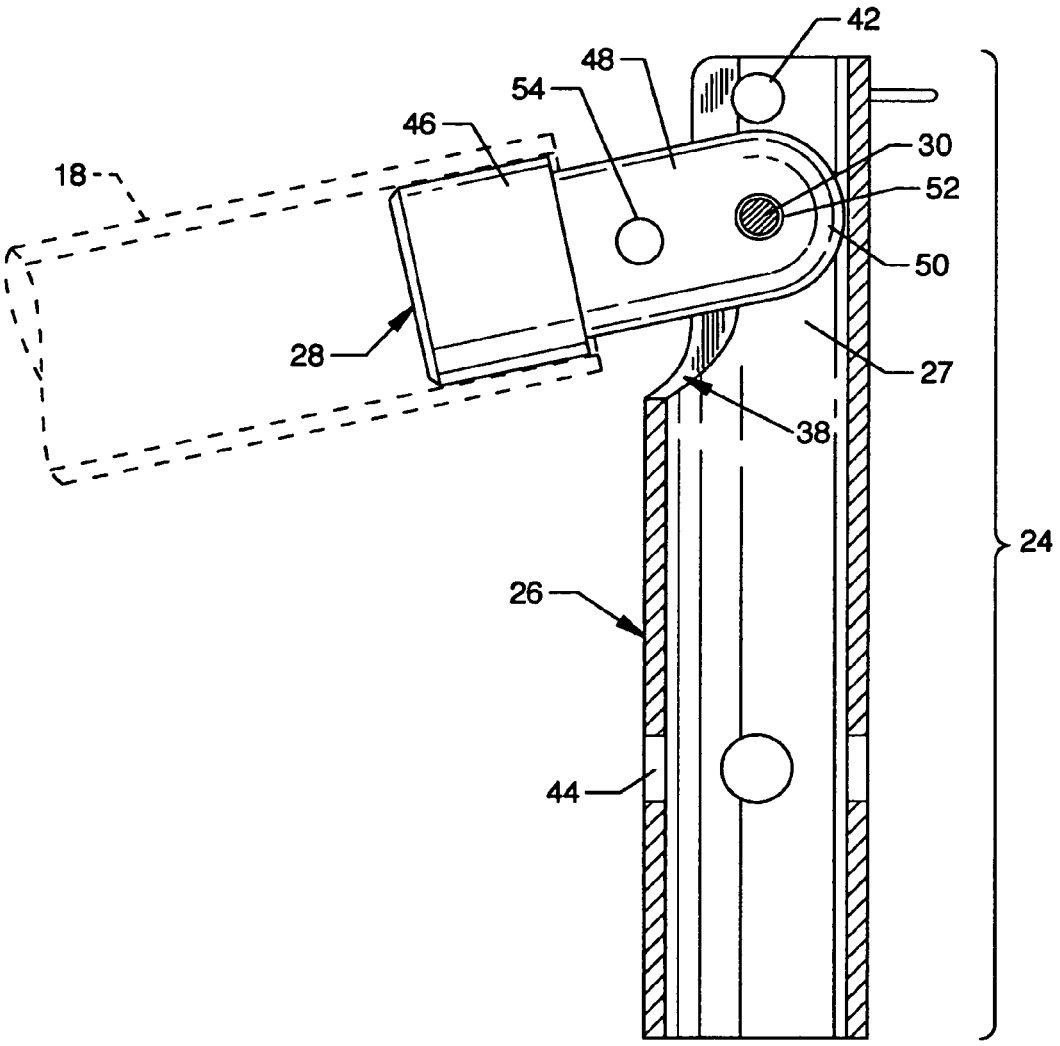
FIG. 5 is a cross section view of the pivot assembly substantially along line 5-5 of FIG. 4 showing the mounting fixture and connected end post pivoted about the pivot pin to position the end post of the collapsible safety rail assembly to provide for minimum viewable profile.

FIG. 5 is a cross section view of the pivot assembly 24 substantially along line 5-5 of FIG. 4 showing the mounting fixture 28 and connected end post 18 (and 16) pivoted about the pivot pin 30 such as to position the end posts 18 of the collapsible safety rail assemblies 12*c*-12*d*, as shown in FIG. 1, to provide for minimum viewable profile. The semispherical-shaped end 50 of the reduced radius shaft 48 is easily accommodated by and maintains clearance with the inside surface 27 of the slotted tubular base 26 to permit sufficient rotation of the mounting fixture 28 therein, as there is no interfering or conflicting geometry. The vertical dimension of the slot 38 is of sufficient length to allow rotation of the mounting fixture 28 below the horizontal aspect to allow the top horizontal rail 20 of the collapsible safety rail assemblies 12*c*-12*d* to contact and rest upon the general horizontal surface upon which the collapsible safety rail system 10 is utilized.

Figure 6:
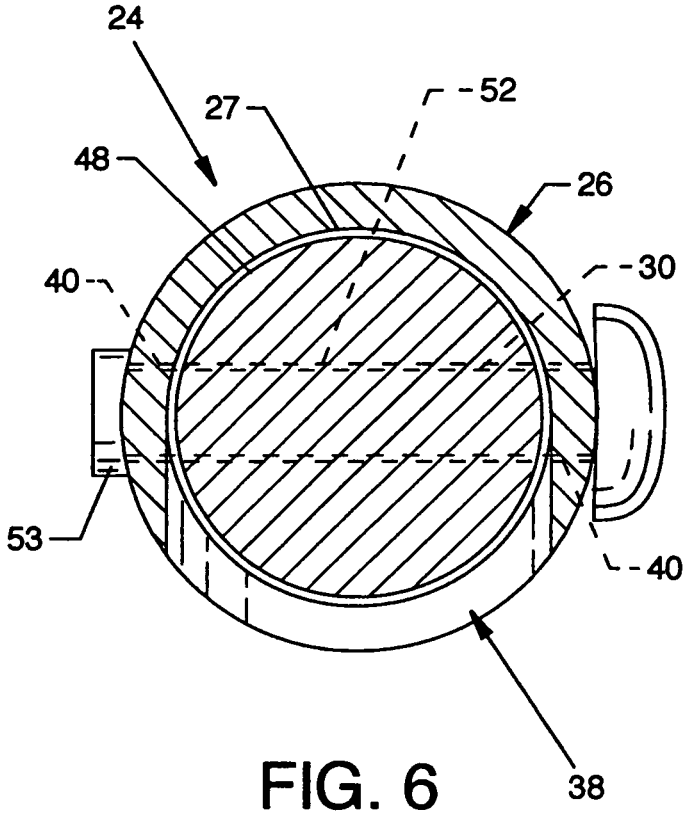
FIG. 6 is a cross section view of the pivot assembly along line 6-6 of FIG. 4.

FIG. 6 is a cross section view of the pivot assembly 24 along line 6-6 of FIG. 4. Shown in particular is the relationship of the reduced radius shaft 48 to the interior surface 27 of the slotted tubular base 26, wherein clearance is provided for pivotal rotation therein.

Figure 7:
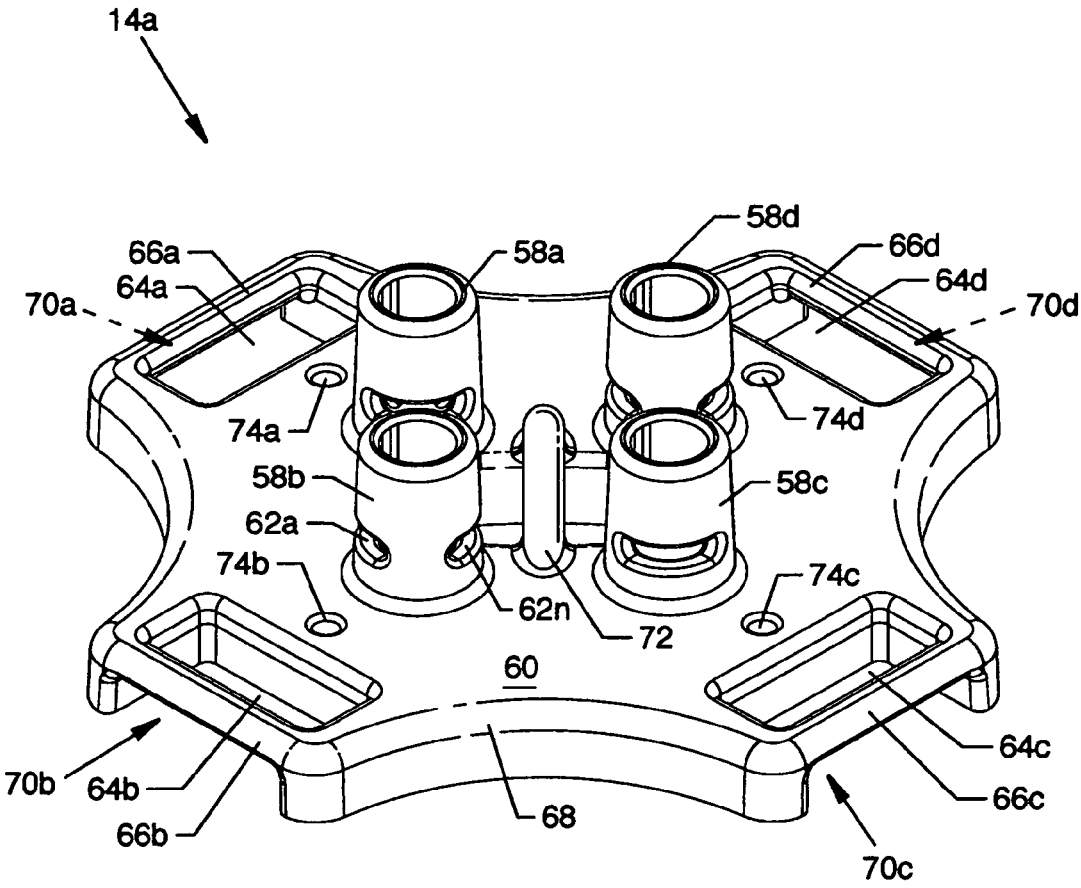
FIG. 7 is an isometric view of a base.

FIG. 7 is an isometric view of the base 14*a*, one of the identical bases 14*a*-14*e* according to the present invention. The bases 14*a*-14*e* can weigh between 100-120 pounds for purposes of example, and can be of cast iron or welded plate and tube to support safety rail sections or assemblies without tipping. The identically constructed bases 14*a*-14*e* include four post receivers 58*a*-58*d* which extend perpendicularly and upwardly from planar top portion or surface 60, any of which can appropriately accommodate the left or right end posts 16 and 18 of the collapsible safety rail assemblies 12*a*-12*d*, as well as other suitably fashioned components, such as, but not limited to, unshown latching posts, gate posts, or locking couplers, which can also include one or more pivot assemblies 24. Each of these post receivers 58*a*-58*d* includes a plurality of horizontally aligned pin receivers, such as slots 62*a*-62*n*, best shown on post receiver 58*b*. Left and right end posts 16 and 18 of the collapsible safety rail assemblies 12*a*-12*d*, as well as other suitably fashioned components, such as, but not limited to, unshown latching posts, gate posts, or locking couplers, all incorporate the plurality of locking pin holes 44 (FIG. 2) for receiving locking pins 36 (FIG. 2) to hold the left and right end posts 16 and 18 of the collapsible safety rail assemblies 12*a*-12*d*, as well as other suitably fashioned components, such as, but not limited to, unshown latching posts, gate posts, or locking couplers in place in the post receivers 58*a*-58*d* of the bases 14*a*-14*e*. The left or right end posts 16 and 18 of the collapsible safety rail assemblies 12*a*-12*d* or other suitably fashioned components, such as, but not limited to, unshown latching posts, gate posts, or locking couplers, are secured to the post receivers 58*a*-58*d* of one or more individual bases 14*a*-14*e* by the use of locking pins 36 extending through opposed locking pin holes 44 and the slots 62*a*-62*n*. Such a relationship allows the left or right end posts 16 and 18 of the collapsible safety rail assemblies 12*a*-12*n*, as well as other suitably fashioned components, such as, but not limited to, unshown latching posts, gate posts, or locking couplers, to pivot as required about the vertical axes of the post receivers 58*a*-58*d*. In the alternative, a base 14*a*-14*e* can also be pivoted about the lower region of a left or right post 16 and 18, respectively, in order to align and utilize other post receivers 58*a*-58*d* or other suitably fashioned components. Each base 14*a*-14*e* may accommodate a maximum of four of the following components in various combinations: left and right end posts 16 and 18 of the collapsible safety rail assemblies 12*a*-12*d* and other suitably fashioned components, such as, but not limited to, unshown latching posts, gate posts, or locking couplers. Each can be locked in any position within its range of motion about a vertical axis by various utilizations of the holes 44, the pin receivers in the form of slots 62*a*-62*n*, and the locking pins 36, all of which together constitute locking means or means for locking the various posts or other suitably fashioned components to the post receivers. It is to be understood that the slots 62*a*-62*n* may be replaced with multiple holes at different heights to accommodate other variously located holes in the lower region of a post, but holes will not allow the infinite 360° range in which the left or right end posts 16 and 18, as well as other suitably fashioned components, such as, but not limited to, unshown latching posts, gate posts, or locking couplers, can be angularly oriented and locked. It is also to be understood that slots, such as slots 62*a*-62*n*, can be included at other levels along and about the post receivers 58*a*-58*d*, as well as at various locations about the circumferences of the post receivers 58*a*-58*d*, to maintain 360° positionable capabilities of any member which engages the interior of the post receivers 58*a*-58*d*.

The bases 14*a*-14*e* include cutouts 64*a*-64*d*, whereby handling of the bases 14*a*-14*e* is readily facilitated in a manual fashion. Each base 14*a*-14*e* is constructed in the same manner having identical parts including the planar top portion or surface 60 with cutouts 64*a*-64*d* on four opposing sides creating built-in recessed handles 66*a*-66*d* for manual transporting or lifting of the bases 14*a*-14*e*. The bases 14*a*-14*e* include a continuous curved or radiused upper edge 68 about the planar top portion or surface 60. The recessed handles 66*a*-66*d* are fashioned to accommodate manual handling and include features making the gripping of the recessed handles 66*a*-66*d* accessible and comfortable. The upper and outer regions of the recessed handles 66*a*-66*d* are formed by portions of the curved or radiused upper edge 68, and the remaining edges forming the recessed handles 66*a*-66*d* have edges which are curved or radiused to eliminate any edges which could prove to be uncomfortable given the weight of the bases 14*a*-14*e*. It is to be appreciated that all of the upper edges of the cutouts 64*a*-64*d* are curved or radiused. Downwardly extending recesses 70*a*-70*d* beneath the recessed handles 66*a*-66*d* provide for manual access under the recessed handles 66*a*-66*d* without first lifting the bases 14*a*-14*e*. There is also a centrally located lifting bar 72 which allows the user to hook the bases 14*a*-14*e* to a pulley, a dolly, or other labor saving device to more easily move the heavy bases 14*a*-14*e*. There are provided holes 74*a*-74*d* which can accommodate anchor bolts for securing the bases 14*a*-14*e* to a work surface, such as a concrete floor or roof top, if permanent mounting is desired.

Stacking recesses (not shown) are recessed into a planar bottom surface of the bases 14*a*-14*e* which align with the upper regions of other post receivers 58*a*-58*d* extending from the planar top portion or surface 60. The stacking recesses are utilized for stacking or storage of bases 14*a*-14*e* when not in use. Also included are drain holes (not shown) extending through the bases 14*a*-14*e* and co-located between the post receivers 58*a*-58*d* and the stacking recesses.

Mode of Operation

Figure 8:
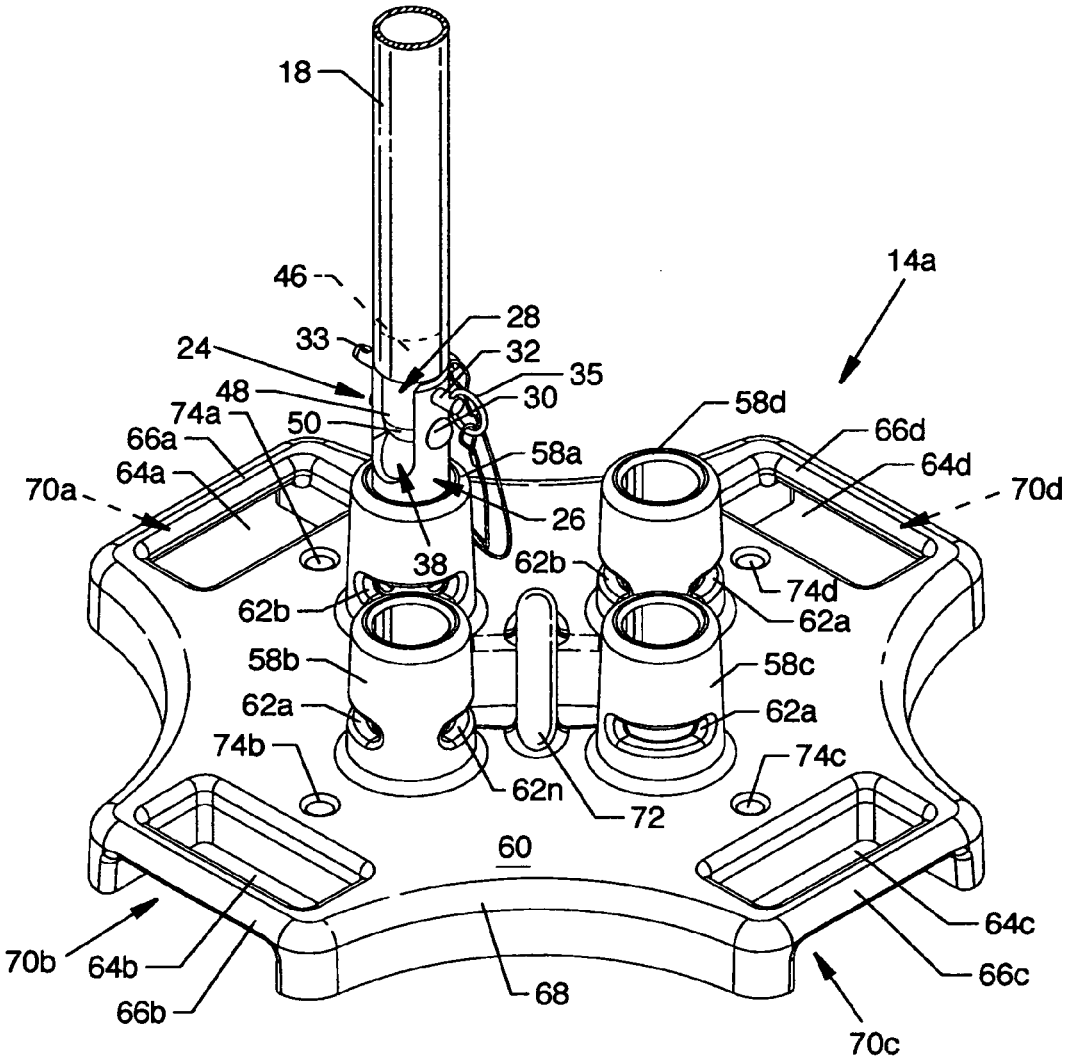
FIG. 8 shows a pivot assembly and a portion of an attached end post aligned vertically in the post receiver prior to pivoting of the mounting fixture and attached end post.
Figure 9:
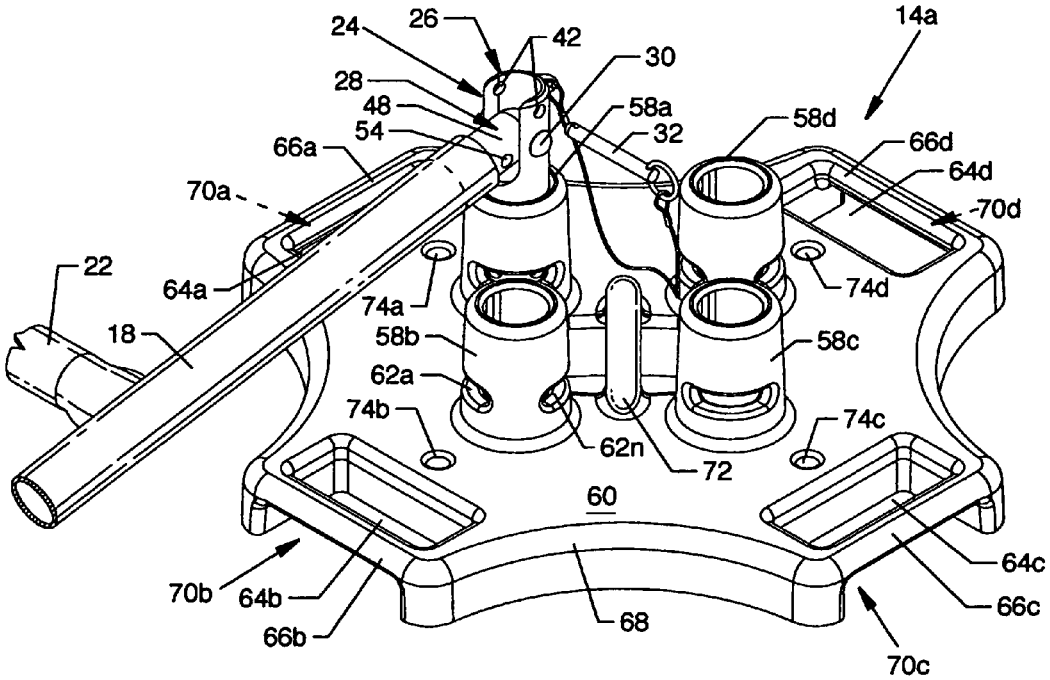
FIG. 9 illustrates the pivoting of the mounting fixture and attached end post to and beyond the horizontal position during positioning of a collapsible safety rail assembly.

FIGS. 8 and 9 best illustrate the mode of operation. FIG. 8 shows a pivot assembly 24 and a portion of an attached end post 18 aligned vertically in the post receiver 58*a* prior to pivoting of the mounting fixture 28 and attached end post 18 (and 16), as well as the rest of a collapsible safety rail assembly 12*c*-12*d* to the collapsed position in a fashion shown in FIG. 1; and FIG. 9 illustrates the pivoting of the mounting fixture 28 and attached end post 18 to and beyond the horizontal position. The locking pin 36 is not shown engaged in the locking position for purposes of brevity.

In FIG. 8, the detent pin 32 and the pivot pin 30 engage both the slotted tubular base 26 and the mounting fixture 28 of the pivot assembly 24, and the pivot assembly 24 engages the post receiver 58*a* of the base 14*a*. Such an arrangement causes the mounting fixture 28 and connected end post 18 to maintain a vertically oriented position, thereby keeping a collapsible safety rail assembly 12*a*-12*b* in the erect and protective mode of operation.

In FIG. 9, the detent pin 32 is shown disengaged from the holes 42 of the slotted tubular base 26 and from the detent pin hole 54 of the reduced radius shaft 48 to allow pivoting of the mounting fixture 28 about the co-located pivot pin hole 52 of the reduced radius shaft 48 and the pivot pin 30. Such pivoting allows repositioning of the mounting fixture 28 and connected end post 18 of a collapsible safety rail assembly 12*c*-12*d* to a collapsed and minimum viewable profile position, as shown in FIG. 1. Understandably, parallel operation and manipulation at another of the bases 14*a*-14*e* at the other end of an associated collapsible safety rail assembly 12*c*-12*d* would occur simultaneously to allow such repositioning of a collapsible safety rail assembly 12*c*-12*d*. Erection of the collapsible safety rail assembly 12*c*-12*d* is accomplished in reverse order. The use of pivot assemblies 24 can also be incorporated into use with the post receivers 58*a*-58*d* of the bases 14*a*-14*d* to provide for collapsing of other related structures, such as, but not limited to, unshown latching posts, gate posts, and the like.

Figure 10:
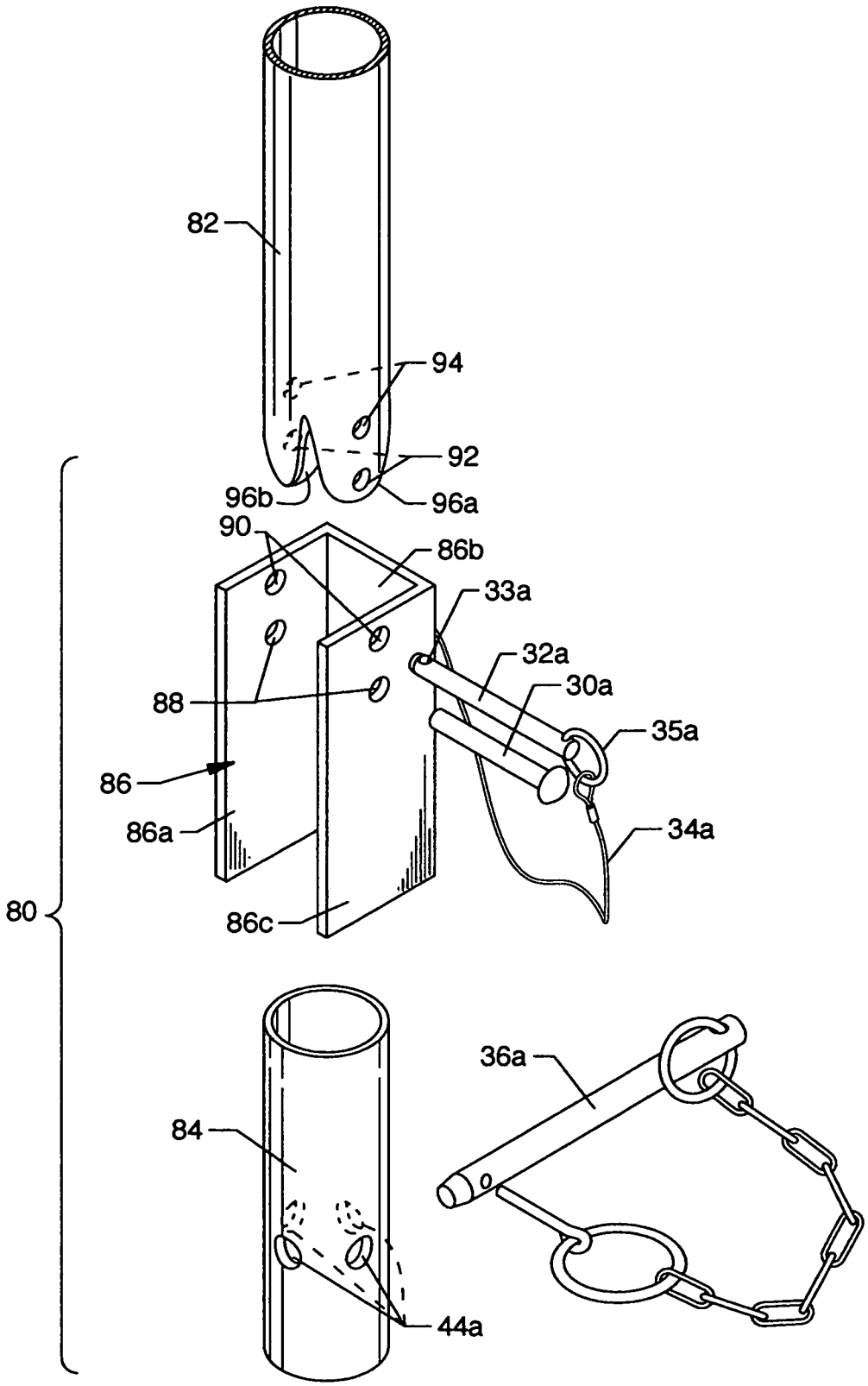
FIG. 10, an alternative embodiment, is an exploded view of a pivot assembly in alignment with an end post.

FIG. 10, an alternative embodiment, is an exploded view of a pivot assembly 80 which could be utilized in lieu of pivot assemblies 24*a* and 24*b* of FIG. 1 shown in relationship to the lower region of an end post 82 which can be utilized in lieu of end post 18 (and 16) to, in part, form collapsible safety rail assemblies generally similar to collapsible safety rail assemblies 12*a*-12*d*. The pivot assembly 80 has major structural components including a stationary tubular base 84 and a vertically aligned mounting fixture 86 resembling a channel having panels 86*a*, 86*b* and 86*c*. Opposed pivot pin holes 88 extend through the upper region of the panels 86*a* and 86*c*, respectively. A pivot pin 30*a* extends through the opposed pivot pin holes 88*a*. A detent pin 32*a* is secured to the mounting fixture 86 by a lanyard 34*a* and ring 35*a*. Opposed detent pin holes 90 align above the opposed pivot pin holes 88 and extend through the upper regions of the panels 86*a* and 86*c*, respectively, for accommodation of the detent pin 32*a*. The detent pin 32*a* includes a spring-loaded ball 33*a*. Also shown is another locking pin 36*a* including suitable hardware for securing of the pivot assembly 80 to one of the bases 14*a*-14*e*.

The end post 82 includes opposed pivot pin holes 92 at the lower edge thereof and opposed detent pin holes 94 aligned above the opposed pivot pin holes 92. The lower portion of the end post 82 includes radiused edges 96*a* and 96*b* which accommodate rotation of the lower region of the end post 82 to provide clearance with the panel 86*b* at the rear of the mounting fixture 86.

The tubular base 84 includes locking pin holes 44*a* which extend through the lower region of the tubular base 84 for accommodation of the locking pin 36*a* when securing the pivot assembly 80 to a base 14*a*-14*e*. The radius of the tubular base 84 and of the end post 82 is nearly as large as the distance between inside surfaces of the panels 86*a* and 86*c* of the mounting fixture 86. Such a relationship allows for robustness and maximizes the structural integrity about the mounting fixture 86 by providing sufficient structural mass about the opposed pivot holes 92 extending through the lower portion of the end post 82. The opposed pivot holes 92 accommodate the pivot pin 30*a* and the opposed detent pin holes 94 provide for accommodation of the detent pin 32*a*.

Figure 11:
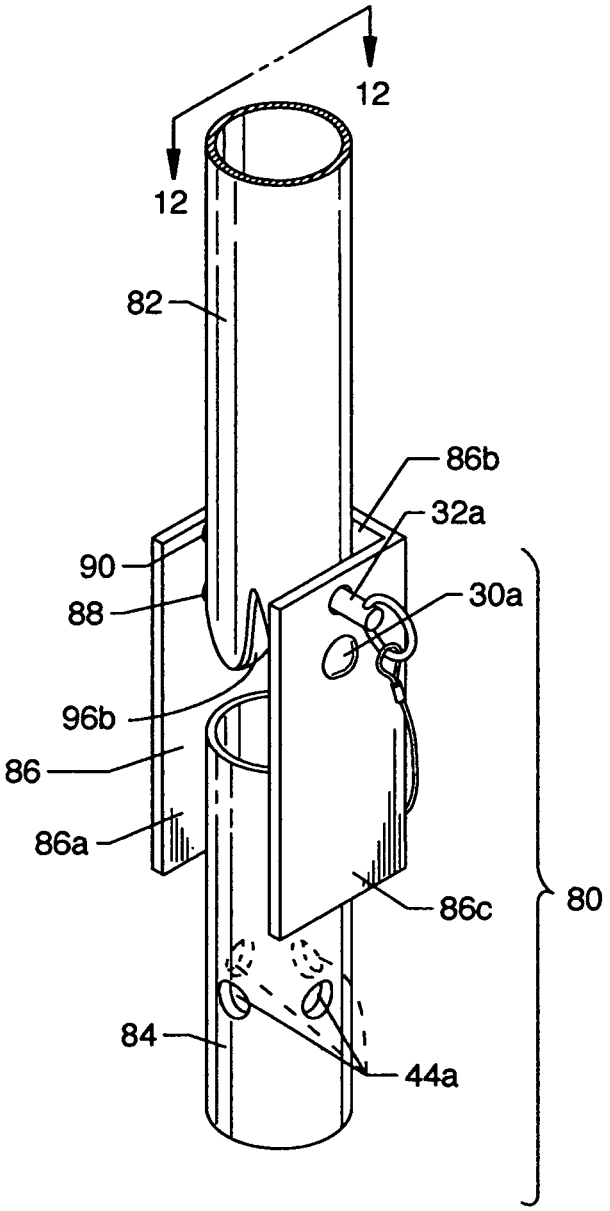
FIG. 11 is an assembled view of elements of FIG. 10.

FIG. 11 is an assembled view of elements of FIG. 10 where the tubular base 84 is attached to the mounting fixture 86, such as by welding, riveting, the use of fasteners, or other suitable methods. The tubular base 84 attaches to the bases 14*a*-14*e* by use of the locking pin 36*a* in a manner previously described. The end post 82 secures to the mounting fixture 86 by the use of the pivot pin 30*a* which extends through the opposed pivot pin holes 88 of the mounting fixture 86 and the opposed pivot pin holes 92 of the end post 82 and is peened over to secure therein. The detent pin 32*a* assists in securing of the end post 82 to the mounting fixture 86. The detent pin 32*a* extends through the opposed detent pin holes 90 of the mounting fixture 86 and through the opposed detent pin holes 94 of the end post 82 and is secured therein by the spring-loaded ball 33*a*.

Figure 12:
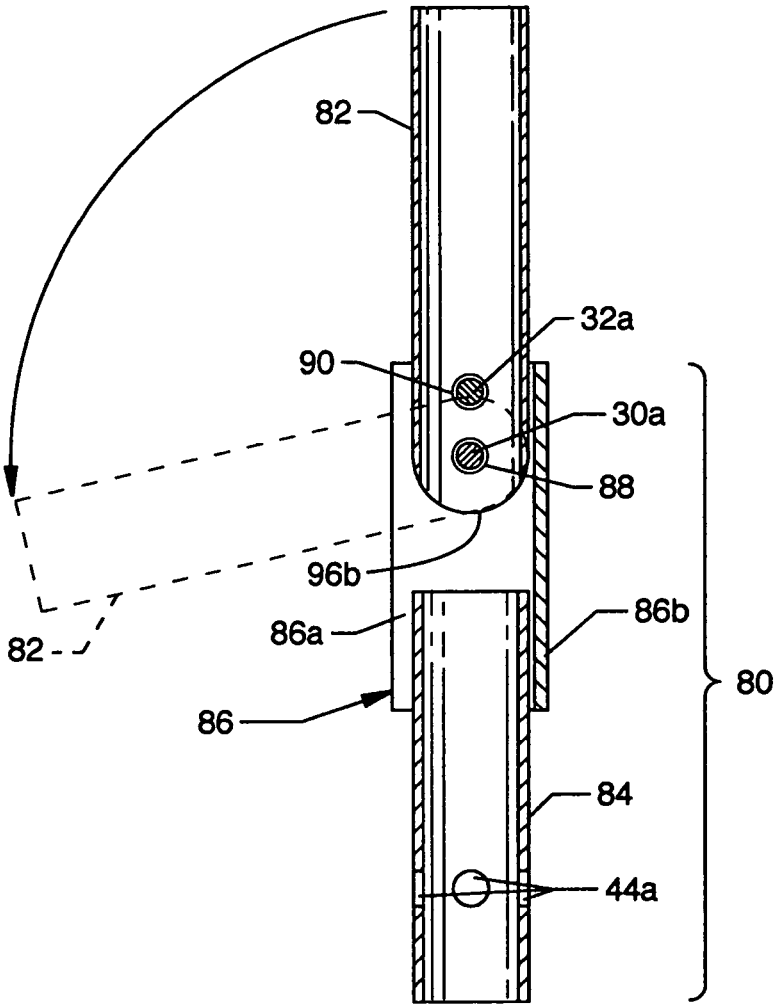
FIG. 12 is a cross section view of a pivot assembly substantially along line 12-12 of FIG. 11.

FIG. 12 is a cross section view of the pivot assembly 80 substantially along line 12-12 of FIG. 11 showing the relationship of the mounting fixture 86, the attached end post 82, and the attached tubular base 84. The end post 82 is pivoted about the pivot pin 30*a* as shown in dashed lines to position the end post 82 in the same manner shown for the collapsible safety rail assemblies 12*c*-12*d* as illustrated in FIG. 1, to provide for minimum viewable profile. The radiused edges 96*a* and 96*b* of the end post 82 are easily accommodated by and maintain clearance with the panel 86*b* of the mounting fixture 86 to permit sufficient rotation of the end post 82 within mounting fixture 86, as there is no interfering or conflicting geometry. The vertical spacing between the top of the tubular base 84 and the end post 82 is of sufficient dimension to allow rotation of the end post 82 below the horizontal aspect to allow the top horizontal rail of the collapsible safety rail assemblies which are generally similar to collapsible safety rail assemblies 12*a*-12*d* to contact and rest upon the general horizontal surface upon which the collapsible safety rail system 10 is utilized.

Operation of the alternative embodiment is similar in many fashions to the operation of the preferred embodiment. The detent pin 32*a* is removed to allow pivoting of the end post 82 about the pivot pin 30*a* in order to maneuver a collapsible safety rail assembly similar in most respects to the collapsible safety rail assemblies 12*a*-12*d*.

Various modifications can be made to the present invention without departing from the apparent scope hereof.

PARTS LIST

| | |
|---|---|
| 10 | collapsible safety rail system |
| 12a-d | collapsible safety rail assemblies |
| 13 | wall section |
| 14a-e | bases |
| 15 | roof |
| 16 | end post |
| 18 | end post |
| 20 | top horizontal rail |
| 22 | bottom horizontal rail |
| 23 | instruction storage tube |
| 24 | pivot assembly |
| 24a-b | pivot assemblies |
| 26 | slotted tubular base |
| 27 | inside surface |
| 28 | mounting fixture |
| 30 | pivot pin |

-continued

PARTS LIST

| | |
|---|---|
| 30a | pivot pin |
| 32 | detent pin |
| 32a | detent pin |
| 33 | spring-loaded ball |
| 33a | spring-loaded ball |
| 34 | lanyard |
| 34a | lanyard |
| 35 | ring |
| 35a | ring |
| 36 | locking pin |
| 36a | locking pin |
| 38 | slot |
| 40 | pivot pin hole |
| 42 | detent pin hole |
| 44 | locking pin hole |
| 44a | locking pin hole |
| 46 | end post mount |
| 48 | reduced radius shaft |
| 50 | semispherical-shaped end |
| 52 | pivot pin hole |
| 53 | peen |
| 54 | detent pin hole |
| 56 | swage |
| 58a-d | post receivers |
| 60 | planar top portion or surface |
| 62a-n | slots |
| 64a-d | cutouts |
| 66a-d | recessed handles |
| 68 | curved or radiused upper edge |
| 70a-d | recesses |
| 72 | lifting bar |
| 74a-d | holes |
| 80 | pivot assembly |
| 82 | end post |
| 84 | tubular base |
| 86 | mounting fixture |
| 86a-c | panels |
| 88 | pivot pin hole |
| 90 | detent pin hole |
| 92 | pivot pin hole |
| 94 | detent pin hole |
| 96a-b | radiused edges |

It is claimed:

1. A collapsible safety rail system comprising a plurality of safety rails, a plurality of support bases spaced from each other on a substrate, the support bases having at least two spaced and upstanding receiving posts thereon, each of said plurality of safety rails having a tubular left-hand post and a tubular right-hand post spaced from said left-hand post, a top rail connected to and extending from said left-hand post to said right-hand post, said left-hand post having a bottom end and said right-hand post having a bottom end, a first pivot assembly interconnecting said bottom end of said left-hand post to a receiving post on one of said plurality of bases and a second pivot assembly interconnecting said bottom end of said right-hand post to a receiving post on another of said plurality of bases, both first and second pivot assemblies including a detent pin for retaining the left hand and right hand posts in an upright position, and both pivot assemblies having a tubular member, one end of which is inserted in said receiving post on said support base and is fixable therein, the opposite end of said tubular member having a slotted section therein, an interconnecting mounting element inserted in an opposite end of said tubular member at the location of said slotted section, said interconnecting mounting element having an upper cylindrical post mount and a lower end shaft with a semispherical shaped end, said upper cylindrical post mount being insertable within the lower end of said left-hand post or the lower end of said right-hand ost and said semisrherical end of said shaft being insertable in the slotted end section of said tubular member, whereby the safety rails are collapsible from the upright position to a generally horizontal position relative to said substrate by means of said both first and second pivot assemblies upon removal of the detent pins such that the left-hand and right-hand posts of one safety rail are pivotable concurrently to the generally horizontal position.

2. The collapsible safety rail system of claim 1, wherein said tubular members of said pivot assemblies have a pivot pin being inserted through opposite holes in said upper end of said tubular member and through opposite holes in said semi-spherical end of said shaft and said shaft of said interconnecting mounting element being pivotable through said slotted section of said tubular member.

3. The collapsible safety rail system of claim 2, wherein the detent pin extends through opposite holes in respective tubular members and through opposite holes in respective shafts above said pivot pin.

4. The collapsible safety rail system of claim 3, wherein there is a locking pin extending through opposite openings in said tubular member and through opposite openings in said post receivers in order to secure said tubular member to said support base.

5. The collapsible safety rail system of claim 4, wherein said opposite openings are slots.

6. The collapsible safety rail system of claim 5, wherein each of said left-hand posts and said right-hand posts are rotatable within a respective receiving post.

7. The collapsible safety rail system of claim 1, wherein said substrate is a floor or a flat roof of a building

8. The collapsible safety rail system of claim 1, wherein said plurality of safety rails are four in number and said plurality of support bases are at least five in number.

9. The collapsible safety rail system of claim 8, wherein there are two safety rails arranged in linear tandem to each other and a pair of safety rails arranged parallel to each other and tangentially to opposite ends of said two safety rails.

10. The collapsible safety rail system of claim 1, wherein said support bases are made from cast iron or other heavy weight material.

11. The collapsible safety rail system of claim 1, wherein said support bases are fixed to said substrate.

12. The collapsible safety rail system of claim 1, wherein said support bases are portable.

13. The safety rail system of claim 1, wherein each of said plurality of safety rails has a lower rail parallely spaced from said top rail and connected to and extending from said left-hand post to said right-hand post.

14. The safety rail system of claim 1, wherein said plurality of safety rails are made from metal.

15. The safety rail system of claim 1, wherein each of said plurality of support bases has at least one cutout therein along an edge thereof for providing a handle therefor.

16. The safety rail system of claim 1, wherein a storage tube containing mounting instructions is attached to one of said plurality of safety rails.

17. The safety rail system of claim 2, wherein there is a sufficient clearance between said semispherical shaped end of said lower end shaft and the inner surface of said tubular member opposite said slotted section such that each of said safety rails is pivotable into a substantially horizontal position relative to said substrate.

18. The safety rail system of claim 5, wherein each of said left-hand posts and said right-hand posts is rotatable within a respective receiving post.

19. The collapsible safety rail system of claim 3, wherein said detent pin has a spring loaded ball at the insertable end thereof and a ring at the opposite end thereof.

20. The collapsible safety rail system of claim 1, wherein each of said support bases has four receiving posts thereon.

* * * * *